United States Patent [19]

Fiddler

[11] 4,440,187

[45] Apr. 3, 1984

[54] PORTABLE SUN SHELTER

[76] Inventor: Maurice K. Fiddler, 31 Hygeia Parade, Ringwood, Victoria, Australia

[21] Appl. No.: 376,488

[22] Filed: May 10, 1982

Related U.S. Application Data

[62] Division of Ser. No. 142,392, Apr. 21, 1980.

[30] Foreign Application Priority Data

Apr. 23, 1979 [AU] Australia ..... PD8509

[51] Int. Cl.[3] ..... E04F 10/04

[52] U.S. Cl. ..... 135/117; 403/161

[58] Field of Search ..... 135/117, 120, 900–903, 135/88, 102, 96; 403/161, 162, 145; 411/544, 908; 5/434, 418; 297/184

[56] References Cited

U.S. PATENT DOCUMENTS 2,932,833 4/1960 Wambach ..... 135/96

2,964,341 12/1960 Doyle et al. ..... 403/162

*Primary Examiner*—Richard J. Apley

*Assistant Examiner*—S. R. Crow

[57] ABSTRACT

A foldable shelter is disclosed which is suitable for personal use on a beach. The shelter includes a number of ribs which are pivotally connected together at their ends so as to enable adjustment or folding of the shelter. The joints are of novel construction and provide for ease of manufacture and more independent movement of the respective ribs.

10 Claims, 4 Drawing Figures

PORTABLE SUN SHELTER

This is a division of application Ser. No. 142,392, filed Apr. 21, 1980.

This invention relates to a portable sun shelter generally of the type disclosed in Australian Patent Specification No. 494,923.

The specification noted above discloses a portable sun shelter which is suitable for personal use on a beach or the like. The shelter has a ribbed framework which is collapsible to a relatively flat state for transport and in which the shelter can be used as a carrying bag. The framework can alternatively be erected into a hood-like arrangement in which state it can be used as a convenient personal sun shelter. The ribs are generally U-shaped and are connected together at joints on either side of the shelter. The joints include a clutch like arrangement which permits the user to alter the relative positions of the ribs by directly moving the ribs themselves without the need to make any adjustments at the joints. This feature makes the shelters most convenient to the users.

The object of the present invention is to provide improved forms of joints in shelters of the character described above.

According to a first aspect of the invention there is provided a foldable shelter comprising a framework having two joints, first, second and a plurality of intermediate ribs each of generally U-shaped configuration, a flexible cover connected to said one end of the cover being connected to the first rib and the other end of the cover being connected to the second rib, one of the free ends of each rib being connected at one of said joints and the other of the free ends of each rib being connected at the other of said joints, said joints permitting the ribs to be rotatable relative to one another, at least one of the joints including resilient means for resiliently restraining rotation of at least the first and second ribs relative to said joints, characterized in that said one joint includes isolating means for isolating rotational movement of the first and second ribs relative to one another so that these can be moved independently.

In a preferred form of the invention the first and second ribs are mounted for rotation on a common shaft but are isolated from one another by an intermediate washer or the like which is non-rotatably mounted on the shaft. In an alternative arrangement the first and second ribs can be mounted on separate shafts so as to effectively isolate rotational movements of the first and second ribs.

The sun shade having a joint or joints as defined above has the advantage that at least the first and second ribs can be moved independently of one another so as to make it easier for the user to effect adjustment of the shelter.

According to a second aspect of the invention there is provided a foldable shelter comprising a framework having two joints, first, second and a plurality of intermediate ribs each of generally U-shaped configuration, a flexible cover connected to said ribs one end of the cover being connected to the first rib and the other end of the cover being connected to the second rib, one of the free ends of each rib being connected at one of said joints and the other of the free ends of each rib being connected at the other of said joints, said joints permitting the ribs to be rotatable relative to one another characterized in that at least one of said joints includes a number of rotatable carrier elements to which the ends of the ribs are connected.

Preferably, the carrier elements are disc like and are provided with an annular recess into which a curved end portion of the free end of the ribs is located.

Preferably, the carrier elements are formed from plastics material.

The invention will now be further described with reference to the accompanying drawings, in which.

Figure 1:
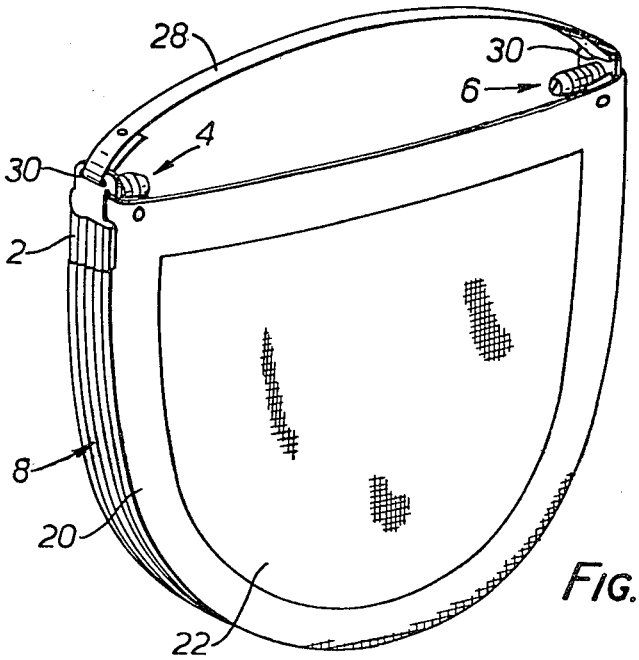
FIG. 1 is a perspective view of a preferred form of sun shelter in its folded condition.
Figure 2:
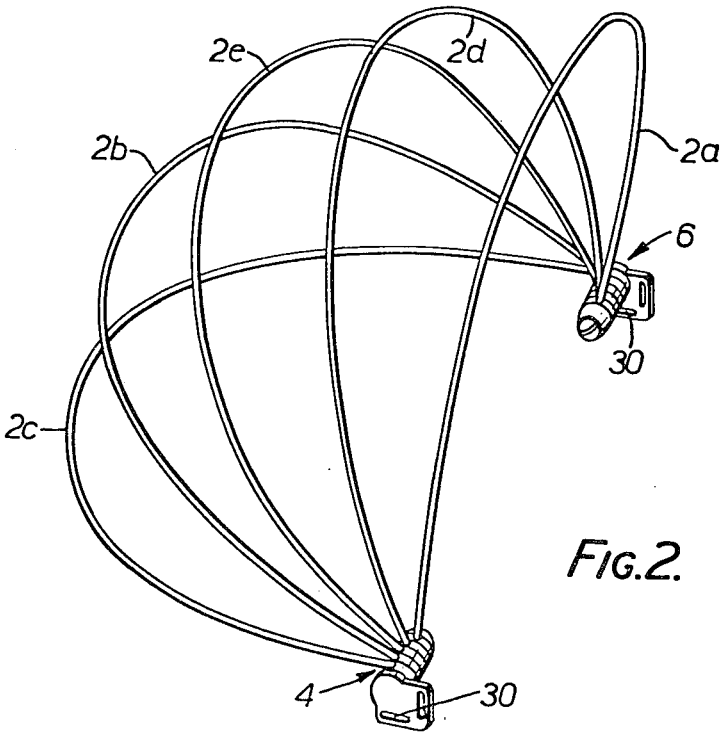
FIG. 2 is a perspective view of the ribbed framework of the shelter.

The illustrated sun shelter comprises a number of generally U-shaped ribs which are preferably formed from wire, the ends of which are pivotally connected at joints 4 and 6. As best seen in FIG. 2, the ribs include a forward rib 2*a*, a rearward rib 2*b*, and a base rib 2*c*. The shelter includes a flexible cover 8 which is attached to each of the ribs except the base rib 2*c* in a manner which permits the shelter to be folded up into a position in which all of the ribs lie generally in the same plane, as best seen in FIG. 1, or alternatively in which the ribs are spaced apart so that the shelter can assume a hood like structure, as best seen in FIG. 2. The shelter includes a generally U-shaped fabric floor 20 which is connected to the base rib 2*c* so that in use the cover 8 can be moved independently of the floor 20. In this way ventilating openings can be formed between the floor and the cover 8. A flap 22 is stitched to the fabric 20 so that the space therebetween can be used as a carrying bag. A strap 28 is provided between the joints between 4 and 6 to make the shelter more useful for this purpose. The ends of the strap 28 are formed with loops which pass through slots 30 formed in the joints 4 and 6.

Figure 3:
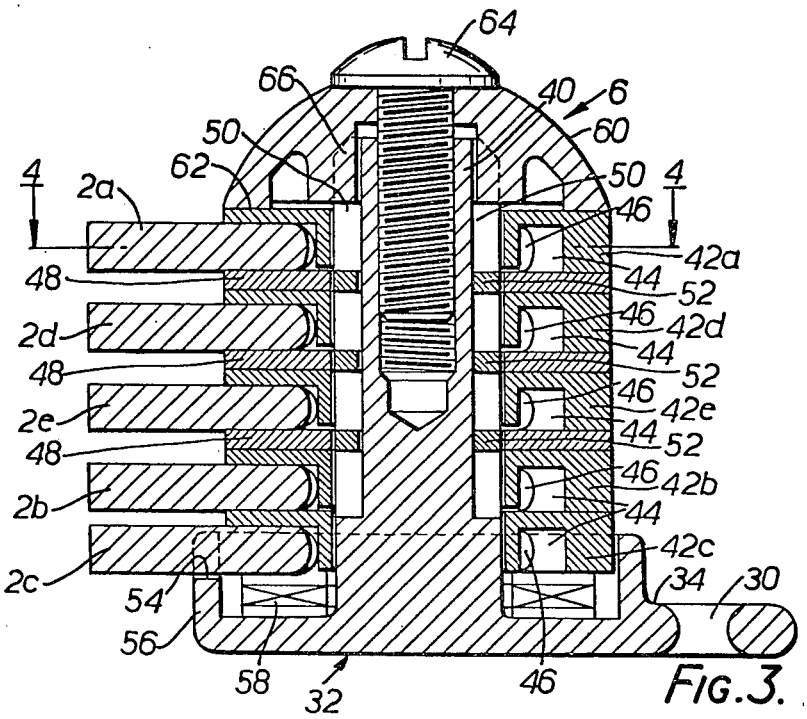
FIG. 3 is a cross-section through a preferred joint which forms part of the framework shown in FIG. 2.
Figure 4:
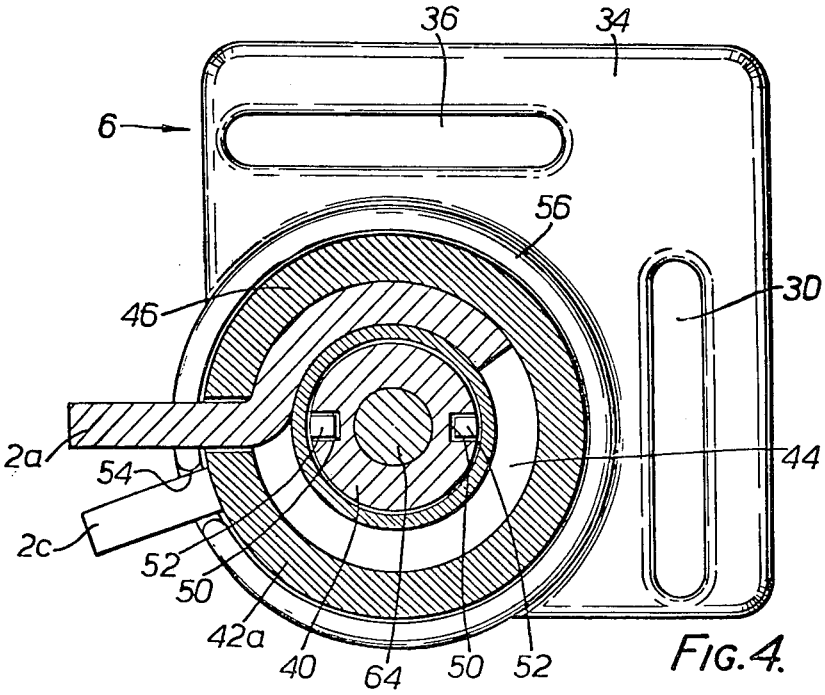
FIG. 4 is a cross-sectional view taken along the line 4—4 marked on FIG. 3.

The preferred form of joint in accordance with the invention is illustrated in more detail in FIGS. 3 and 4. The joints include a body portion 32 which is preferably moulded from plastics material such as nylon (Registered Trade Mark). The body 32 includes a plate portion 34 formed with the slot 30 and a second slot 36 which is used as a connecting point for the fabric floor 20. Projecting outwardly from the plate 34 is a central shaft portion 40 formed with an internally threaded bore. Rotatably mounted on the shaft 40 are disc carriers 42*a*, 42*b*, 42*c*, 42*d* and 42*e*. Each of the carriers has an annular recess 44 into which curved end portions 46 of the ribs are located. The carriers 46 are preferably moulded from plastics material such as nylon (Registered Trade Mark). Washers 48 are interposed between the carriers 42*a* and 42*d*, 42*d* and 42*e*, and 42*e* and 42*b* so as to effectively isolate rotational movement of the ribs 2*a*, 2*b*, 2*d*, and 2*e* from one another. This isolation is enhanced by making the washers 48 non-rotatably mounted on the shaft 38. This is preferably effected by providing a pair of axial slots 50 into which project teeth 52 formed on the inner peripheries of the washers 48.

The base rib 2*c* is non-rotatably mounted relative to the body 32 and this is effected by means of engagement in a recess 54 formed in an annular projection 56 upstanding from the plate 32. A compression spring say in the form of a spring washer 58 is located on the shaft 40 between the plate 34 and acts between the plate 34 and the carrier 42*c*. The carriers 42 are retained on the shaft 40 by means of an end moulding 60 having an annular surface 62 which bears against the side of the carrier 42*a*. The end moulding 60 is retained in position by means of a screw 64 which is threadably received in the shaft 40. The moulding 60 is provided with inwardly projecting tab portions 66 which engage the slots 50 of the shaft and prevent the moulding from rotating relative to the shaft. It will be appreciated that adjustment of the screw 64 alters the axial position of the moulding 60 and thereby determines the axial compressive forces applied by the spring 58. The joint thus acts as a friction clutch in which the carriers 42 are movable independently of one another. It will be appreciated that the arrangement of the invention is simple to construct and is of neat appearance. Further, it will be appreciated that it could be modified in many ways. For instance, all of the disc carriers 42 need not be mounted on a common shaft. Further, it is not necessary that all of the ribs be resiliently restrained against rotation since the shelter can be effectively used if only the first and second ribs 2*a* and 2*b* are so restrained. The spring 58 is mounted between washers 59 which help distribute the load on adjacent components of plastics materials and thus avoid stress concentrations.

Many modifications will be apparent to those skilled in the art without departing from the spirit and scope of the invention.

I claim:

1. A foldable shelter comprising a framework having two joints, a first rib, a second rib and a plurality of intermediate ribs each of generally U-shaped configuration, a flexible cover connected to said ribs one end of the cover being connected to the first rib and other end of the cover being connected to the second rib, one of the ends of each rib being connected at one of said joints and the other of the ends of each rib being connected at the other of said joints, said joints permitting the ribs to be rotatable relative to one another characterized in that at least one of said joints includes a number of rotatable carrier elements, said carrier elements being disc shaped and their outer surfaces lying substantially on a common cylindrical surface and each having an annular recess into which a curved end portion of the rib is located.

2. A shelter as claimed in claim 1 wherein the carrier elements are formed from plastics material.

3. A shelter as claimed in claim 1 wherein said elements each have an axial width which is greater than the thickness of the rib connected thereto whereby the ribs can be rotated so as to lie in a common plane.

4. A foldable shelter comprising a framework having two joints; a first rib, a second rib and a plurality of single-pieced intermediate ribs each being of U-shaped configuration and at least one rib having at least one curved end portion; a flexible cover connected to said ribs, one end of the cover being connected to the first rib and the other end of the cover being connected to the second rib, one of the ends of each rib being connected at one of said joints and the other of the ends of each rib being connected at the other of said joints, said joints permitting the ribs to be rotatable relative to one another characterized in that at least one of said joints includes a number of disc-shaped, coaxial, rotatable carrier elements to which the ends of the ribs are connected, at least one of said carrier elements having an annular recess into which said at least one curved end portion of said at least one of said ribs is received.

5. A foldable shelter comprising a framework having two joints, a first rib, a second rib and a plurality of pieced intermediate ribs each of U-shaped configuration, and at least one rib having at least one curved end portion, a flexible cover connected to said ribs, one end of the cover being connected to the first rib and other end of the cover being connected to the second rib, one of the ends of each rib being connected at one of said joints and the other of the ends of each rib being connected at the other of said joints, said joints permitting the ribs to be rotatable relative to one another, characterized in that at least one of said joints includes a number of disc-shaped, coaxial, rotatable carrier elements to which the ends of the ribs are connected, at least one of said carrier elements having an annular recess into which said at least one curved end portion of said at least one of said ribs is received and wherein said elements each have an axial width relative to its axis of rotation which is greater than the thickness of the rib connected thereto, whereby the ribs can be rotated so as to lie in a substantially common plane.

6. A shelter as claimed in claim 5 wherein the carrier elements are disc like and are provided with an annular recess into which a curved end portion of the free end of the ribs is located.

7. A foldable shelter comprising a framework having two joints, first rib, second rib, and a plurality of intermediate ribs each of generally U-shaped configuration, a flexible cover connected to said ribs one end of the cover being connected to the first rib and the other end of the cover being connected to the second rib, one of the ends of each rib being connected at one of said joints and the other of the ends of each rib being connected at the other of said joints, said joints permitting the ribs to be rotatable relative to one another characterized in that at least one of said joints includes a number of rotatable carrier elements in which the ends of the ribs are mounted, said carrier elements being disc shaped and formed from synthetic plastic material and said at least one joint includes spring means to apply resilient axial compressive forces to said rotatable carrier elements whereby said elements function as friction clutch members.

8. A shelter as claimed in claim 7 wherein the carrier elements are disc like and are provided with an annular recess into which a curved end portion of the free end of the ribs is located.

9. A shelter as claimed in claim 7 wherein said elements each have an axial width which is greater than the thickness of the rib connected thereto whereby the ribs can be rotated so as to lie in a common plane.

10. A shelter as claimed in claim 7 wherein washers of synthetic plastic material are interposed between at least some of the adjacent pairs of carrier elements whereby said washers will exert frictional forces on the carriers elements or ribs which frictional forces will tend to resist rotation of the carrier elements.

* * * * *